United States Patent [19]

Birt

[11] Patent Number: 4,520,434

[45] Date of Patent: May 28, 1985

[54] DIFFUSION COVER FOR A MOTOR VEHICLE HEADLAMP

[75] Inventor: David A. Birt, Cannock, England

[73] Assignee: Lucas Industries, Birmingham, England

[21] Appl. No.: 518,107

[22] Filed: Jul. 28, 1983

[30] Foreign Application Priority Data

Aug. 20, 1982 [GB] United Kingdom ..... 8224035

[51] Int. Cl.[3] ..... F21V 29/00

[52] U.S. Cl. ..... 362/309; 362/61; 362/80; 362/83; 362/311; 362/328; 362/335; 362/340; 362/355

[58] Field of Search ..... 362/61, 80, 83, 311, 362/328, 325, 332, 335, 267, 307, 308, 309, 310, 277, 294, 355, 340; 313/113

[56] References Cited

U.S. PATENT DOCUMENTS 3,539,799 11/1970 Dangauthier ..... 362/328
4,446,511 5/1984 Sands ..... 362/80

FOREIGN PATENT DOCUMENTS 1220355 7/1966 Fed. Rep. of Germany .

*Primary Examiner*—Donald P. Walsh
*Attorney, Agent, or Firm*—Staas & Halsey

[57] ABSTRACT

A diffusion cover for a motor vehicle headlamp comprising upper and lower mutually inclined translucent cover portions are integrally joined together to define therebetween a ridge on an outer surface of the cover and a trough on an inner surface of the cover. In order to obviate or mitigate glare, the trough is disposed above the ridge, the inner surface of the upper cover portion in the region of the trough is of concave form so that the prismatic effect in said region increases in the direction of the trough, the inner surface of the lower cover portion in the region of the trough is of convex form so that the prismatic effect in said region increases in the direction of the trough, and the mutual disposition of the inner and outer surfaces of each cover portion in the respective regions of the ridge and the trough is such that light rays from a reflector of the headlamp which are incident upon the inner surface of the cover in use are not refracted upwardly upon passage through said regions of the upper and lower cover portions.

2 Claims, 4 Drawing Figures

DIFFUSION COVER FOR A MOTOR VEHICLE HEADLAMP

Figure 1:
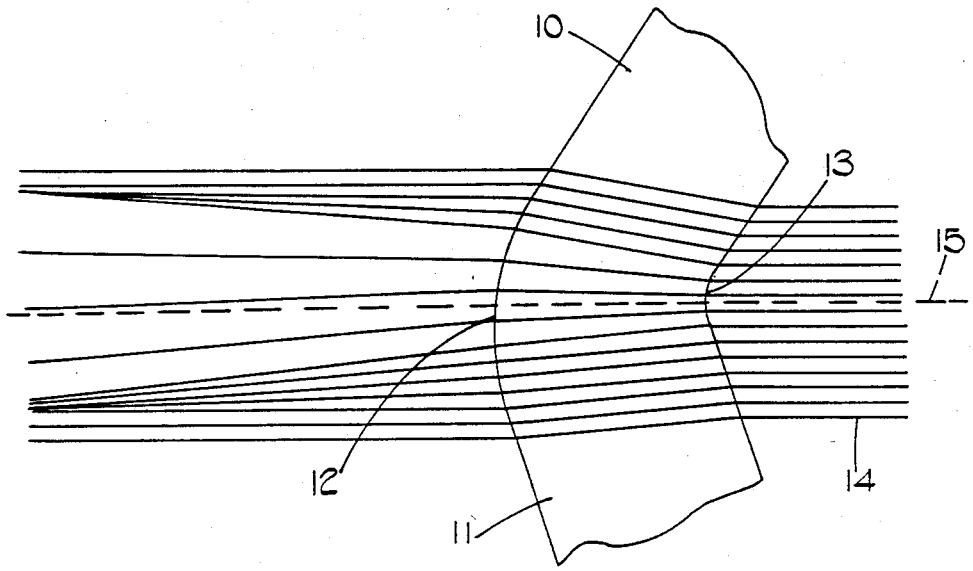

This invention relates to a diffusion cover for a motor vehicle headlamp and is particularly concerned with a diffusion cover of the type comprising upper and lower mutually inclined translucent cover portions which define therebetween a peak line or ridge on an outer surface of the cover and a trough on an inner surface of the cover.

Diffusion covers of the above type have been proposed for styling and streamlining purposes so that the outer surface of the diffusion cover has a shape which merges with the outer shape of the front of the vehicle body. Examples of such diffusion covers for motor vehicles are disclosed in GB-1158069 and GB-1079954. Such diffusion covers are generally moulded from glass so that the front and rear surfaces of the cover portions are substantially parallel with each other. However, because glass cannot be successfully moulded with very sharp edges, this results in the ridge and the trough being radiussed. The result of this is that there is defined effectively a concavo-convex lens which imparts a vertical spread of light. Such a vertical spread of light is to be avoided because it leads to glare problems. In other words, it is difficult for motor vehicle headlamps fitted with such diffusion covers to satisfy the stringent photometric requirements for homologation purposes.

An object of the present invention is to provide a diffusion cover of the above type in which the above mentioned disadvantage is obviated or mitigated.

According to the present invention, there is provided a diffusion cover for a motor vehicle headlamp, comprising upper and lower mutually inclined translucent cover portions which are integrally joined together to define therebetween a ridge on an outer surface of the cover and a trough on an inner surface of the cover, wherein the trough is disposed above the ridge, the inner surface of the upper cover portion in the region of the trough is of concave form so that the prismatic effect in said region increases in the direction of the trough, the inner surface of the lower cover portion in the region of the trough is of convex form so that the prismatic effect in said region increases in the direction of the trough, and the mutual disposition of the inner and outer surfaces of each cover portion in the respective regions of the ridge and the trough is such that light rays from a reflector of the headlamp which are incident upon the inner surface of the cover in use are not refracted upwardly upon passage through said regions of the upper and lower cover portions.

The expressions "upper", "lower", "upwardly", and "horizontal" refer to the situation when the diffusion cover is in an orientation corresponding to that in which it is designed to be used on a motor vehicle.

The degree of concavity and convexity of the inner surface regions of the upper and lower cover portions depends upon various factors, such as the refractive index of the material of construction of the diffusion cover, the angle of mutual inclination of the upper and lower portions, the vertical spacing between the trough and the ridge, and the radii of curvature of the trough and the ridge.

By providing such convex and concave regions, a more gradual transition between the relatively thick lower cover portion and the relatively thin upper cover portion can be obtained compared with the case where it is attempted to mitigate the glare problem merely by displacing the trough above the ridge, whilst maintaining the inner and outer surfaces of each cover portion substantially parallel as is conventional. Thus, with the above described diffusion cover, the thickness of the lower cover portion is at a minimum in the region of its joint with the upper cover portion and increases over the region thereof which has a convex inner surface up to the thickness of the remainder of the lower cover portion. Conversely, the thickness of the upper cover region is at a maximum in the region of its joint with the lower cover portion and decreases over the region thereof having the concave inner surface, to the thickness of the remainder of the upper cover portion. It is to be appreciated that the above described regions of the upper and lower cover portions having the concave and convex inner surfaces, respectively, only occupy a small percentage of the total area of the diffusion cover.

The convex and concave region are conveniently arcuately curved. However, they may be parabolically or elliptically curved. For any particular application, the dispostion of the origin of curvature (i.e. the centre in the case of an arcuately curved convex or concave region) and the radius of curvature (in the case of an arcuately curved convex or concave region) or the focal length (in the case of a parabolically curved convex or concave region), are chosen so as to obtain the required prismatic effects at the trough-remote and through-adjacent ends of the region, with respect to parallel light emanating from the reflector. The prismatic effects required for a particular diffusion cover can be ascertained by trial and experiment using the diffusion cover moulded with a mutually displaced ridge and trough but without the concave and convex sections.

As is usual with diffusion covers for motor vehicle headlamps, the inner surface of the diffusion cover will be provided with lensing elements for producing the required overall distribution of light to satisfy the relevant regulations.

An embodiment of the present invention will now be described, by way of example, with reference to the accompanying drawings, in which:-

Figure 2:
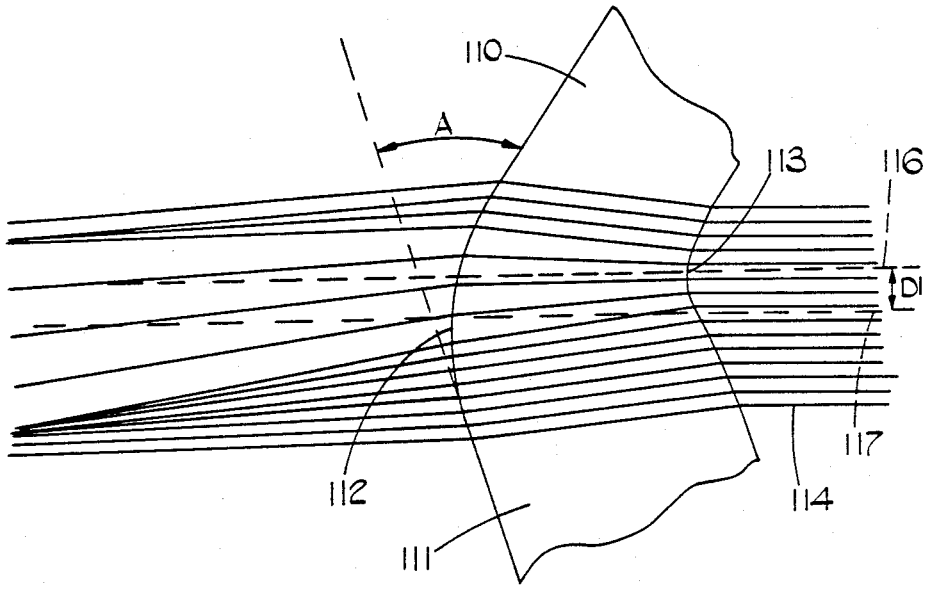
Figure 3:
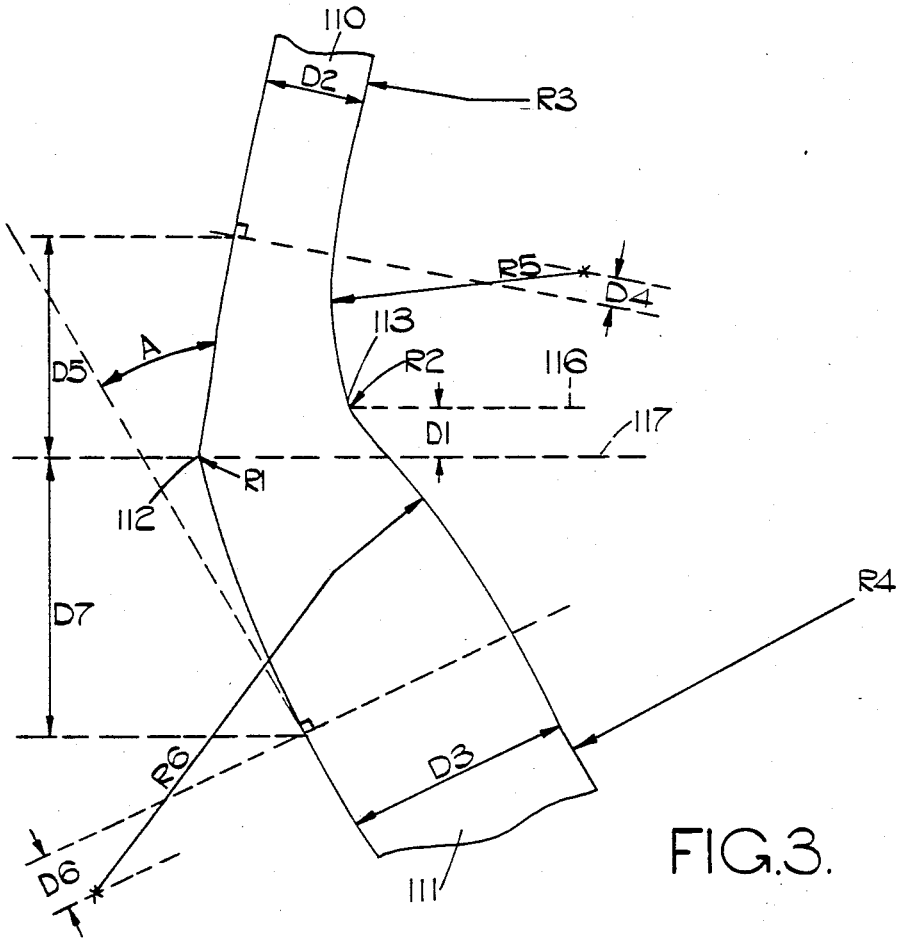
Figure 4:
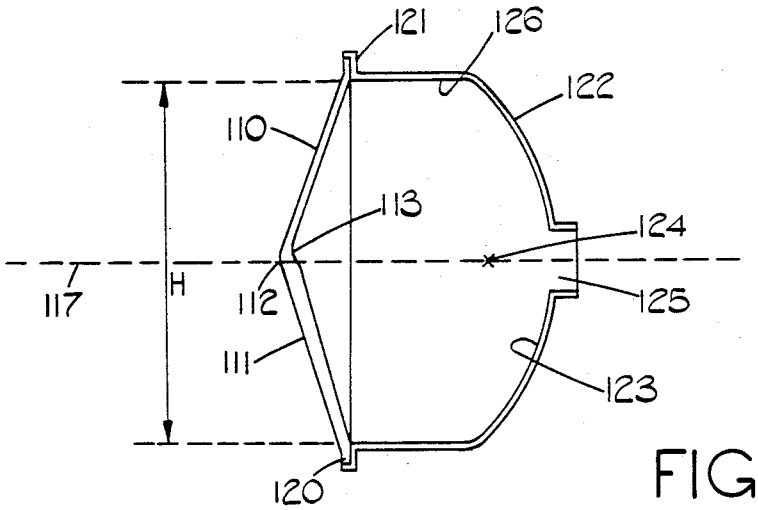

FIG. 1 is a schematic diagram illustrating the effect produced by a previously proposed diffusion cover, FIG. 2 is a diagram illustrating the effect produced by a diffusion cover according to the present invention, FIG. 3 is a view on an enlarged scale of part of a diffusion cover according to the present invention, FIG. 4 is a schematic illustration of a vehicle headlight fitted with a diffusion cover according to the present invention.

Referring now to FIG. 1, the diffusion cover partly illustrated therein is a conventional diffusion cover for a motor vehicle headlamp and is moulded from glass so as to comprise upper and lower mutually inclined translucent cover portions 10 and 11 which are integrally joined together to define therebetween a peak line or ridge 12 on an outer surface of the cover and a corresponding trough 13 on the inner surface of the cover. The inner and outer surfaces of each cover portion 10, 11 are substantially parallel. The outer surface of each cover portion 10, 11 is unpatterned whereas the inner surface thereof, in accordance with conventional practice, is provided with a lensing pattern thereon to reduce the required light distribution or diffusion to achieve the required illumination of the road. Because the diffusion cover is moulded out of glass, it is not possible for the ridge 12 or trough 13 to be sharply defined by a horizontal line extending across the diffusion cover. Instead, and as shown in FIG. 1, both the ridge 12 and the trough 13 are radiussed. This has the result of defining a concavo-convex lens at the location where the cover portions 10 and 11 join. As a result of this, a vertical spread of light is produced. As illustrated in FIG. 1, a parallel beam of light rays 14 emanating from a reflector of the headlight which is incident upon the inner surface of the diffusion cover in the region of the trough 13 is vertically spread so that some of the light rays, upon emerging from the outer surface of the diffusion cover are projected upwardly rather than downwardly as desired. This causes glare problems to oncoming drivers and means that it is difficult, if not impossible, for a motor vehicle headlamp fitted with such a diffusion cover to satisfy the stringent ridge 12.

Referring now to FIGS. 2 and 3, the diffusion cover illustrated therein is in accordance with an example of the present invention. The diffusion cover comprises upper and lower mutually inclined, translucent cover portions 110 and 111 which are integrally joined together to define therebetween a ridge 112 on an outer surface of the cover and a trough 113 on the inner surface of the cover. In this embodiment, however, the diffusion cover is moulded with the trough 113 higher than the ridge 112 so that the horizontal median plane 16 of the trough 113 lies a distance D1 above the horizontal median plane 117 of the ridge 112. With the exception of regions of the upper and lower cover portions 110 and 111 adjacent the ridge 112 and the trough 113, the majority of each of the upper and lower cover portions 110 and 113 have inner and outer surfaces which are generally parallel and spaced apart by a distance D2 in the case of the upper cover portion 110 and D3 in the case of the lower cover portion 111. D3 is greater than D2. The radius of curvature of the ridge 112 is R1 whilst the radius of curvature of the trough 113 is R2. The inner surface of the majority of the upper cover portion 110 is defined by a surface having an arcuate section of radius R3. The majority of the inner surface of the lower cover portion 111 is of arcuate section with radius R4. The remainder of the inner surface of the upper cover portion 110, i.e. that region thereof between the arcuate portion of radius R3 and the trough 113, is concave and is of arcuate cross-section of radius R5. The centre of the arc of radius R5 is disposed at a distance D4 from a perpendicular to the front surface of the cover portion 110, said perpendicular lying at a distance D5 from the horizontal median plane 117 of the ridge 112.

The region of the inner surface of the lower cover portion 111 lying between the arcuate portion of radius R4 and the trough 113 is of convex form with an arcuate cross-section of radius R6. The centre of the arc of radius R6 is spaced a distance D6 from a perpendicular to the front surface of the lower cover portion 111, said perpendicular lying a distance D7 from the horizontal median plane 117 of the ridge 112. The outer surface of the upper cover portion 110 is radiussed in a like manner to the radiussing of the majority of the inner surface thereof so that it lies parallel therewith. The outer surface of the lower cover portion 111 is similarly radiussed with respect to the radiussing of the majority of the inner surface thereof at R4.

Referring now to FIG. 4, the diffusion cover is surrounded by a peripheral flange 120 by which it is secured by means of an adhesive/sealant (not shown) to a peripheral flange 121 of a motor vehicle headlamp reflector 122. In accordance with conventional practice, the reflector 122 has an internal paraboloidal reflective surface 123 having its focus at 124. An opening 125 is provided in the rear of the reflector 122 for receiving the body of a bulb (not shown) having a filament which is disposed so that it passes through the focus 124. The height of the diffusion cover not including the peripheral flange 120 is H (see FIG. 4); the horizontal median plane 117 of the trough 112 passes through the focus 124 and the focal axis of the reflective surface 123 lies in the median plane 117.

It will be appreciated from the above that, when the filament of the bulb is illuminated, light rays which are reflected off the paraboloidal reflective surface 123 will be projected forwardly as a substantially parallel beam of light rays 114 (see FIG. 2). Because of the displacement of the trough 113 above the ridge 112 and because of the shape chosen for the regions of the upper and lower cover portions 110 and 111 adjacent the ridge 112 and trough 113, the light rays are not vertically spread as in the case of the embodiment of FIG. 1 but are all refracted downwardly as illustrated in FIG. 2 so that the above-discussed glare problem no longer occurs.

In a particular embodiment, the above described effect can be produced with a diffusion cover as described above wherein the following conditions apply:-

| | |
|---|---|
| D1 equals 1.35 mm | R1 equals 4.00 mm |
| D2 equals 3.50 mm | R2 equals 1.00 mm |
| D3 equals 4.60 mm | R3 equals 1500 mm |
| D4 equals 2.50 mm | R4 equals 500 mm |
| D5 equals 4.00 mm | R5 equals 35 mm |
| D6 equals 1.00 mm | R6 equals 50.00 mm |
| D7 equals 5.00 mm | A equals 33 degrees |

Refraction index = 1.43 H equals 120 mm Such an arrangement gives prism angles of 2 degrees and 6 degrees at the top and bottom of the concave region and prism angles of 6 degrees and 1 degree at the top and bottom of the convex region.

In another embodiment, the above-described effect can be produced with a diffusion cover as described above wherein the following conditions apply:-

| | |
|---|---|
| D1 equals 0.5 mm | R1 equals 8 mm |
| D2 equals 4.0 mm | R2 equals 2 mm |
| D3 equals 6.35 mm | R3 equals 1000 mm |
| D4 equals 4.0 mm | R4 equals 700 mm |
| D5 equals 6.0 mm | R5 equals 30 mm |
| D6 equals 2.5 mm | R6 equals 45 mm |
| D7 equals 6.0 mm | A equals 52° |

Refractive index = 1.43 H equals 120 mm

Such an arrangement gives prism angles of 2.5 degrees and 9 degrees at the top and bottom of the concave region and 2.5 degrees and 18 degrees at the top and bottom of the convex region.

In the above described embodiment as illustrated in FIG. 4, the ridge 112 is shown as located in the centre horizontal median plane 117. However, it need not usually be so located and very often will be displaced therefrom. Typically, in the case of the above-described articular embodiment where A = 33.6 degrees and H = 120 mm, the ridge 112 will be disposed 80 mm below the top flat 126 of the reflector 122.

I claim:

1. A diffusion cover for a motor vehicle headlamp, comprising:

upper and lower mutually inclined translucent cover portions which are integrally joined together to define therebetween a ridge on an outer surface of the cover and a trough on an inner surface of the cover, wherein the trough is disposed above the ridge;

concave means, comprising the inner surface of the upper cover portion in the region of the trough, for increasing the prismatic effect in said region in the direction of the trough;

convex means, integrally formed with said concave means and comprising the inner surface of the lower cover portion in the region of the trough, for increasing the prismatic effect in said region of the trough and in the direction of the trough, and the mutual disposition of the inner and outer surfaces of each cover portion in the respective regions of the ridge and the trough is such that light rays from a reflector of the headlamp which are incident upon the inner surface of the cover in use are not refracted upwardly upon passage through said regions of the upper and lower cover portions.

2. A diffusion cover as claimed in claim 1, wherein the concave means and the convex means of said upper and lower cover portions are accurately curved.

* * * * *